US007319184B2

(12) United States Patent
Lang

(10) Patent No.: US 7,319,184 B2
(45) Date of Patent: Jan. 15, 2008

(54) PERCUSSION INSTRUMENT

(75) Inventor: Thomas Lang, Mill Hill East (GB)

(73) Assignee: Roland Meinl Musik Instrumente GmbH & Co. KG, Neustadt/Aisch (DE)

( * ) Notice: Subject to any disclaimer, the term of this patent is extended or adjusted under 35 U.S.C. 154(b) by 0 days.

(21) Appl. No.: 11/167,604

(22) Filed: Jun. 28, 2005

(65) Prior Publication Data

US 2006/0207407 A1 Sep. 21, 2006

(30) Foreign Application Priority Data

Mar. 19, 2005 (DE) ..... 10 2005 012 784

(51) Int. Cl.
*G10D 13/02* (2006.01)

(52) U.S. Cl. ..... 84/411 R

(58) Field of Classification Search ..... 84/411 R, 84/419, 420; 446/418
See application file for complete search history.

(56) References Cited

U.S. PATENT DOCUMENTS

| | | | | |
|---|---|---|---|---|
| 3,626,458 | A * | 12/1971 | Zickos | 84/411 R |
| 6,175,068 | B1 * | 1/2001 | Belli | 84/414 |
| 2004/0081915 | A1 * | 4/2004 | Andrews | 430/293 |
| 2004/0139839 | A1 * | 7/2004 | Chiang | 84/411 R |

* cited by examiner

*Primary Examiner*—Kimberly Lockett
(74) *Attorney, Agent, or Firm*—Browdy and Neimark, PLLC

(57) ABSTRACT

In a percussion instrument such as a drum, conga, bongo or the like, comprising a resonance body and a skin that is stretched over a top opening of the resonance body and has an imprint, it is provided that the skin (3) is transparent or semi-transparent and that an imprint (18) is applied to the bottom of the skin.

3 Claims, 1 Drawing Sheet

PERCUSSION INSTRUMENT

BACKGROUND OF THE INVENTION

1. Field of the Invention

The invention relates to a percussion instrument such as a drum, conga, bongo or the like, comprising a resonance body and a skin that is stretched over a top opening of the resonance body.

2. Background Art

Conventionally, a manufacturer's mark or logo is applied to the top of the respective musical instrument or skin.

Playing on the skin with sticks means considerable wear of the surface of the skin so that, after prolonged use, the imprint is no longer legible or at least considerably affected optically.

When a musician plays on the skin with his hands, his tactile sensation of the imprinted area will differ from that of the other areas of the skin, which sensitive musicians feel to be interfering.

SUMMARY OF THE INVENTION

It is an object of the invention to avoid the prior art drawbacks described above.

According to the invention, this object is attained by the skin being transparent or semi-transparent and by the imprint being applied to the bottom of the skin. Preferably the skin is a transparent plastic skin.

Applying the imprint to the bottom side helps avoid any mechanical effects on the printing ink, and the surface of the skin is continuous and uniform on the outside i.e., the imprint does not make itself felt during playing.

Moreover, a special, novel effect of design is obtained by the positioning according to the invention. An interesting optical impression appears even with semi-transparent skins.

Details of the invention will become apparent from the ensuing description of a preferred embodiment, taken in conjunction with the drawing.

DESCRIPTION OF A PREFERRED EMBODIMENT

Figure 1:
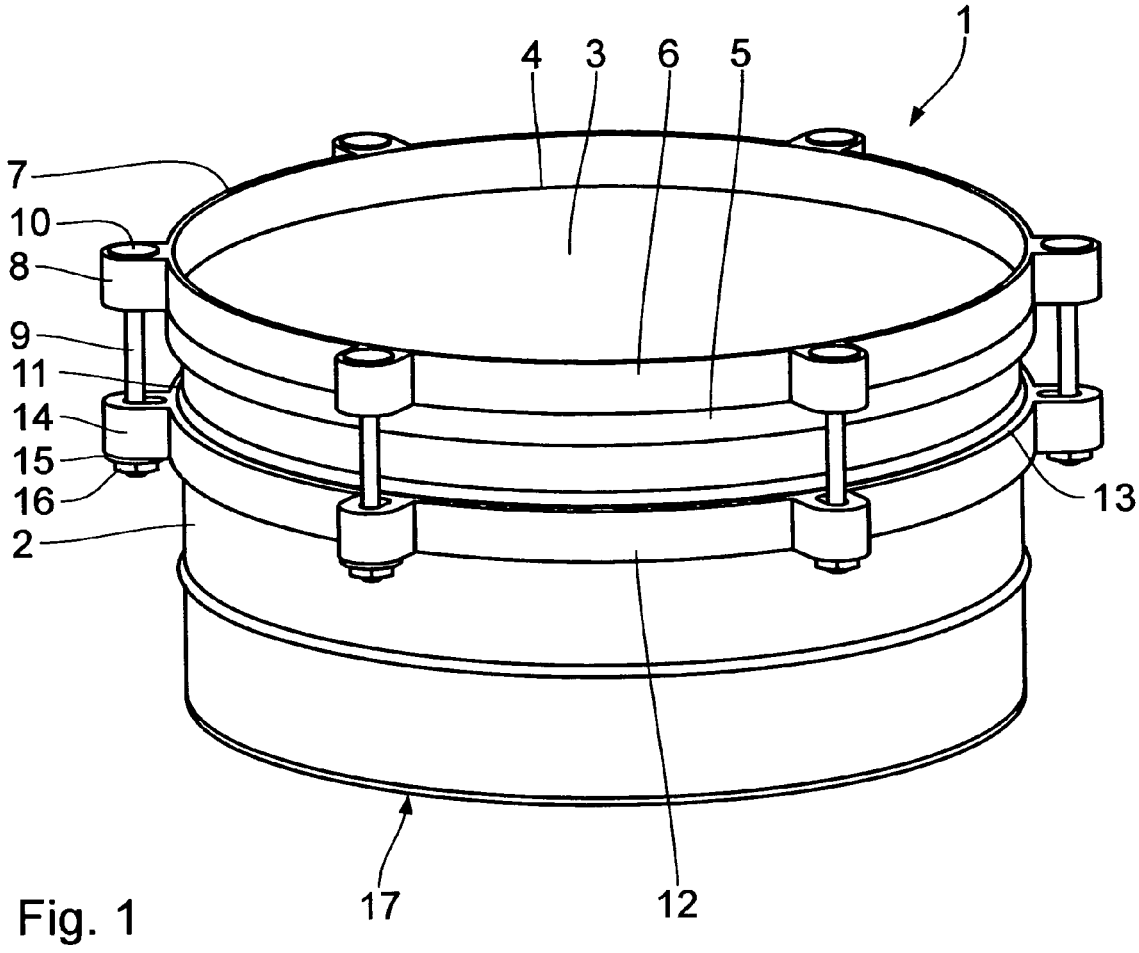
FIG. 1 is a perspective view of a drum.

As seen in the drawing, a drum 1 comprises a substantially cylindrical basic structure 2, over the top of which a skin 3 is stretched by way of a holding hoop 5 which is located under the skin and, therefore, cannot be seen in the drawing; the holding hoop 5 has a lateral, encircling shoulder 4.

A first clamping hoop 6 corresponds in cross section to the space left free by the shoulder 4 so that it can be placed over the outer rim of the skin 3 onto the shoulder 4 in such a way that its upper edge 7 projects over the skin and the vertical outside is in alignment with the part of the holding hoop 5 below the shoulder 4.

A plurality of lugs 8 are welded on the first clamping hoop 6 at a distance from each other. Straining screws 9 are inserted in these lugs 8, with the head 10 of the straining screws 9 resting of the top side of the lugs 8.

In proximity to the holding hoop 5 for the skin 3, the basic structure 2 comprises an encircling annular bead 11 in the form of a bulging of the basic structure 2 that is a sheet metal cylinder.

Below the annular bead 11 provision is made for a second clamping hoop 12, the top edge 13 of which rests on the annular bead 11. The second clamping hoop 12 comprises a plurality of lugs 14 of the same angular spacing as the lugs 8 of the first clamping hoop 6.

The straining screws 9 pass downwards through the second lugs 14, with a shim 15 and a nut 16 being placed on the free bottom end of the straining screws 9.

Tightening the nuts 16 clamps the first clamping hoop 6, and thus the holding hoop 5, against the second clamping hoop 12 that rests on the annular bead 11.

Another skin can be stretched over the free end 17 in the same way as the skin 3 specified above.

Figure 2:
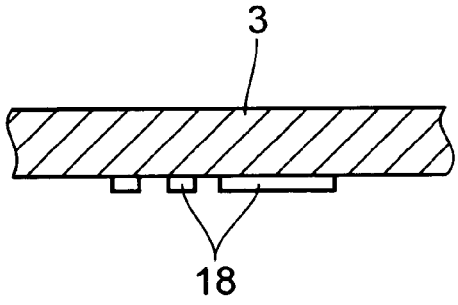
FIG. 2 is a vertical sectional view of a skin.

As seen in FIG. 2, an imprint 18 formed by printing ink is applied on the surface of the bottom of the skin 3. The skin 3 consists of a transparent plastic film so that the imprint is visible from above and outside.

Any skins or skin laminates of at least a certain transparency can be used as the skin 3.

What is claimed is:

1. A percussion instrument such as a drum, conga, bongo of the like, comprising a resonance body and a skin which is stretched over the top opening of the resonance body, having an imprint, wherein the skin (3) is transparent or semi-transparent and has a continuous, smooth and uniform surface on the bottom of the skin wherein an imprint (18) formed by printing ink is applied on the surface of the bottom of the skin (3), and wherein the imprint is visible through the top surface of the skin.

2. A percussion instrument according to claim 1, wherein the skin (3) is a transparent plastic skin.

3. A percussion instrument according to claim 1, wherein the imprint (18) displays a manufacturer's mark or logo.

* * * * *